US009784008B1

(12) United States Patent
Carolina

(10) Patent No.: US 9,784,008 B1
(45) Date of Patent: Oct. 10, 2017

(54) PORTABLE CHANGING TENT

(71) Applicant: Corey Carolina, Tulsa, OK (US)

(72) Inventor: Corey Carolina, Tulsa, OK (US)

( * ) Notice: Subject to any disclaimer, the term of this patent is extended or adjusted under 35 U.S.C. 154(b) by 0 days.

(21) Appl. No.: 14/927,023

(22) Filed: Oct. 29, 2015

Related U.S. Application Data

(60) Provisional application No. 62/072,717, filed on Oct. 30, 2014.

(51) Int. Cl.
*E04H 15/48* (2006.01)
*E04H 15/32* (2006.01)

(52) U.S. Cl.
CPC ..... *E04H 15/48* (2013.01); *E04H 15/32* (2013.01)

(58) Field of Classification Search
CPC ..... E04H 15/48; E04H 15/44; E04H 15/32; E04H 15/28; Y10T 403/44; Y10T 403/342
USPC ..... 135/98, 124, 128, 135, 147, 159; 403/170–173, 217–219
See application file for complete search history.

(56) References Cited

U.S. PATENT DOCUMENTS 2,953,145 A * 9/1960 Moss ..... E04H 15/28 135/117
4,966,178 A * 10/1990 Eichhorn ..... E04H 15/28 135/123
5,046,882 A * 9/1991 Ju ..... E04H 15/40 135/135
5,328,286 A * 7/1994 Lee ..... E04H 15/48 135/135
5,645,096 A 7/1997 Hazinski et al.
5,800,067 A 9/1998 Easter
6,257,263 B1 7/2001 Brereton
6,378,445 B1 4/2002 Willard, Sr. et al.
7,201,177 B2 4/2007 Anticoli et al.
7,607,447 B1 * 10/2009 Han ..... E04H 15/28 135/135
7,628,165 B2 * 12/2009 Rothweil ..... E04H 15/48 135/135
7,841,572 B2 * 11/2010 Chen ..... A63H 33/006 248/284.1
8,069,872 B2 * 12/2011 Bae ..... E04H 15/48 135/147
8,360,085 B2 * 1/2013 Lee ..... E04H 15/48 135/135
8,496,019 B2 * 7/2013 Zhou ..... E04H 15/42 135/135
2002/0020439 A1 2/2002 Tate
(Continued)

*Primary Examiner* — Winnie Yip
(74) *Attorney, Agent, or Firm* — GableGotwals

(57) ABSTRACT

A locking mechanism for a portable changing tent includes a puck body that houses a locking plate having a perimeter defined by at least three sets of alternating concave- and convex-shaped surfaces. A knob located at an uppermost end of the puck body rotates the locking plate between a fully unlocked and a fully locked position. The vertical centerline of the puck body's leg receivers is aligned with a corresponding horizontal centerline of the concave-shaped surface of the locking plate when the knob is in the fully locked position. The vertical centerline of each leg receiver is aligned with a corresponding horizontal centerline of the concave-shaped surface of the locking plate when the knob is in the fully unlocked position. Each concave-shaped surface of the locking plate urges against an end of a respective leg connector when the locking plate is in the fully locked position.

5 Claims, 6 Drawing Sheets

(56) References Cited

U.S. PATENT DOCUMENTS

| | | | | |
|---|---|---|---|---|
| 2005/0224107 | A1* | 10/2005 | Yang | E04H 15/48 135/135 |
| 2007/0051399 | A1* | 3/2007 | Jung | E04H 15/48 135/135 |
| 2010/0162484 | A1 | 7/2010 | Thomas et al. | |
| 2013/0008478 | A1* | 1/2013 | Prieto Estebanez | E04H 15/32 135/147 |
| 2013/0025064 | A1 | 1/2013 | Holden et al. | |

* cited by examiner

Folded View

Legs Down View

Legs Extended View

Legs Bowed With Puck Press Down View

LOCKED

UNLOCKED

PORTABLE CHANGING TENT

CROSS REFERENCE TO PENDING APPLICATIONS

This application claims priority to U.S. provisional application 62/072,717 for Portable Changing Tent filed Oct. 30, 2014.

BACKGROUND OF THE INVENTION

This invention is generally in the field of tents that can be easily and readily deployed for use, such as a "pop-up" tent. More specifically, this invention relates to tents having frames that can be folded for compact storage of the tent yet easily and readily deployed for immediate use.

U.S. Pat. No. 5,645,096 A to Hazinski et al, U.S. Pat. No. 5,800,067 to Easter, U.S. Pat. No. 6,257,263 B1 to Brereton, and U.S. Pat. No. 7,201,177 B2 to Anitcoli et al. disclose pop-up tents having a semi-rigid frame that can be coiled into overlapping loops for storage and self-erected when released. The fabric material cannot be removed from the frame.

US 2002/0020439 A1 to Tate discloses a pop-up tent that allows the fabric material to be removed but its frame requires more assembly than those which do not allow fabric removal.

U.S. Pat. No. 6,378,445 B1 to Willard, Sr. et al., US 2010/0162484 A1 to Thomas et al., and US 2013/0025064 A1 to Holden et al. disclose a mobile changing table assembly but no privacy for the infant or toddler.

None of the portable tents provides means at the uppermost end of the frame to help deploy the frame into its final (in use) shape and lock that final shape into place.

SUMMARY OF THE INVENTION

A portable changing tent made according to this invention moves between a folded, compact state and an unfolded, deployed state to provide privacy for an infant or toddler when changing a diaper or clothing. A set of four, hinged legs provide a frame for a washable, nylon or nylon-type fabric material. Each leg is secured at its upper end to a central puck which is then used to deploy the tent.

The tent's frame assembly includes two or more hinged legs and a puck located at an uppermost end of the frame assembly and connected to an upper end of each of the hinged legs. Each hinged leg has a hinge that permits a lower end of the hinged leg to fall away from a respective upper end of the hinged leg. At the end of the lower leg's fall away travel, the hinged leg has a first vertical height with a first outward bow. With the legs in this position, when the puck is pressed downward the hinged legs move to a second, lower vertical height having a second, larger outward bow. The puck includes a lock for maintaining the frame assembly in this second, lower vertical height.

To use the tent, a user holds onto the puck and lifts the tent upright so that the lowermost end of each leg touches the ground or table top surface, with the legs slightly bowed outwards. The user then pushes down on the puck to bow the legs further outward to tighten the fabric and create a dome-shaped tent. Once the legs are bowed into a final position, a knob is turned to lock the legs and, therefore, the frame assembly into place. Unlocking the puck by turning the knob back to its unlocked position releases the tension on the legs, which can then collapse and can be folded for compact storage of the tent.

In a preferred embodiment of the locking mechanism for a tent frame, the locking mechanism includes a puck body having at least three leg receivers arranged about its perimeter, each leg receiver having a vertical centerline. The puck body houses a locking plate that has a perimeter defined by at least three sets of alternating concave- and convex-shaped surfaces; each concave- and convex-shaped surface having a horizontal centerline. A knob is located at an uppermost end of the puck body and arranged to rotate the locking plate between a fully unlocked and a fully locked position.

The vertical centerline of each leg receiver is aligned with a corresponding horizontal centerline of the concave-shaped surface of the locking plate when the knob is in the fully locked position, and the vertical centerline of each leg receiver is aligned with a corresponding horizontal centerline of the concave-shaped surface of the locking plate when the knob is in the fully unlocked position. Each concave-shaped surface of the locking plate urges against an end of a respective leg connector when the locking plate is in the fully locked position.

The locking mechanism may also include each leg receiver having a pivot connection to a leg connector, the leg connector arranged to move between a vertical position and a horizontal position as a vertical downward force is applied to the puck body. A leg can be connected to each leg connector, with each leg having a hinge arranged to permit a lower end of the leg to fall away from a respective upper end of the leg and create an outward bow of the leg when a vertical downward force is applied to the puck body.

In a preferred embodiment of a portable changing tent, a frame assembly includes at least three legs and a puck located at an uppermost end of the frame assembly. The puck has at least three leg receivers and houses a locking plate in communication with the leg receivers. Each leg receiver is connected to an upper end of a respective legs. with each leg being in a pivotal relationship to its respective leg receiver. Each leg also has a hinge that permits a lower end of the leg to fall away from a respective upper end of the leg and, when a vertical downward force is applied to the puck, the legs bow outward along their respective lengths.

The locking plate of the puck can have a perimeter defined by at least three sets of alternating concave- and convex-shaped surfaces, each concave- and convex-shaped surface having a horizontal centerline. A vertical centerline of each leg receiver is aligned with a corresponding horizontal centerline of the concave-shaped surface when the locking plate is in the fully locked position, a vertical centerline of each leg receiver is aligned with a corresponding horizontal centerline of the concave-shaped surface when the locking plate is in the fully unlocked position. A knob located at an uppermost end of the puck body rotates the locking plate between a fully unlocked and a fully locked position.

In another preferred embodiment, the portable changing tent includes a frame assembly having at least three legs and a puck located at its uppermost end. The puck has at least three leg receivers and at least three leg connectors, each leg connector arranged in pivotal relation to a respective leg receiver. The puck also has a locking plate in communication with the leg receivers and leg connectors so that a perimeter of the locking plate urges against an end of each leg connector when the plate is in the fully locked position and not contacting the leg connector when the plate is in the fully unlocked position.

Objectives of this invention include providing a portable changing tent that (1) can be easily deployed, with one hand being used to place the frame into its outwardly bowed state; (2) does not require any sort of anchoring device to secure the frame to the ground; (3) locks the frame into place so the frame does not collapse during use; and (4) permits the fabric material to be removed from the frames for cleaning and maintenance.

NUMBERING AND ELEMENTS USED IN THE DRAWINGS

Figure 2:
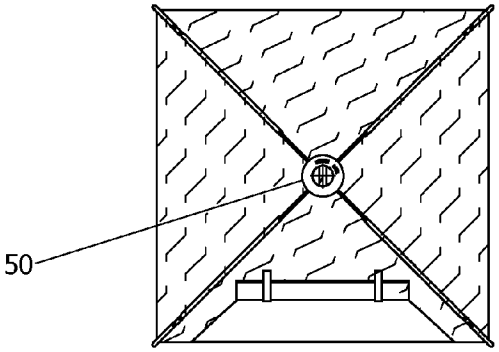
FIG. 2 is a top view of the tent of FIG. 1.
Figure 3:
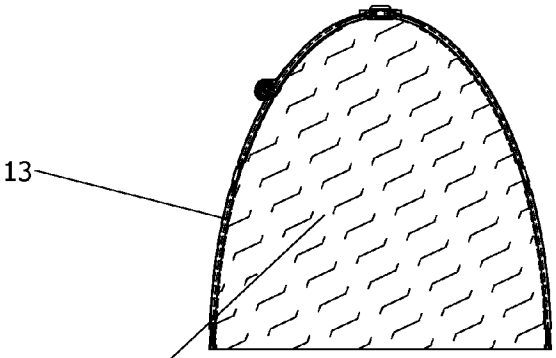
FIG. 3 is a side view of the tent of FIG. 1.
Figure 1:
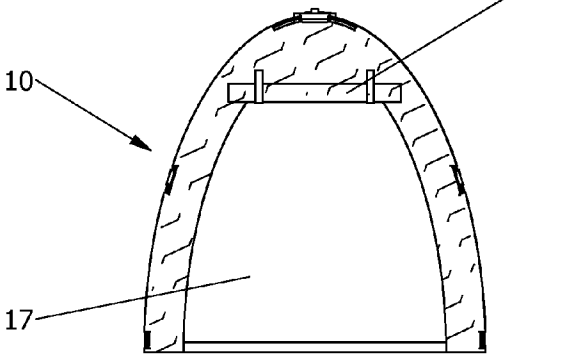
FIG. 1 is front view of a preferred embodiment of a portable changing tent made according to this invention when in its fully deployed state.

10 Portable changing tent
11 Fabric
13 Sleeve
15 Flap or door cover
17 Front opening
20 Frame assembly
30 Leg or hinged leg
31 Upper leg or upper end of leg
33 Leg hinge
35 Lower leg or lower end of leg
50 Puck body or locking mechanism
51 Top plate
52 Wings or flange surfaces forming upper portion of leg- or leg connector receiver
53 Middle portion or locking plate
54 Perimeter of 53
55 Concave polygonal-shaped or notch surface
56 Horizontal centerline of 55
57 Convex arcuate-shaped surface
58 Horizontal centerline of 57
59 Base
61 Leg connector
62 Wings or flange surfaces forming lower portion of leg- or leg connector receiver
63 Central recess
65 Pins or fasteners
66 Perimeter of 50
67 Pivot point or connection
68 Vertical centerline of 52, 62
70 Knob

DETAILED DESCRIPTION OF THE PREFERRED EMBODIMENTS

Referring to FIGS. 1 to 6D, a preferred embodiment of a portable changing tent 10 made according to this invention includes a frame assembly 20 including two or more hinged legs 30 and a puck 50 located at an uppermost end of the frame assembly 20 and connected to an upper end of each of the hinged legs 30. Each hinged leg 30 has a hinge 33 that permits a lower end 35 of the hinged leg 30 to fall away from a respective upper end 31 of the hinged leg 30 and, at the end of the fall away travel, provide each hinged leg 30 with a first vertical height. Additionally, at the end of this fall away travel, the upper and lower ends 31, 35 do not form a straight line but instead the lower end 35 is angled slightly inward, giving a slightly outwardly bowed appearance to the leg 30. When the legs 30 are in this position, and the puck 50 is pressed downwardly, the legs 30 bow further outward and have a second, lower vertical height. The puck 50 includes a lock 53 for locking the upper end of each of the hinged legs 30 when the legs 30 are in this second, lower vertical height Referring to FIGS. 1 to 3, a preferred embodiment of a portable changing tent 10 made according to this invention includes a washable polyester, nylon or nylon-type fabric 11 having sleeves 13 for receiving the legs 30 of a frame assembly 20. The fabric 11 is preferably translucent, provides an SPF 50, and fire and water resistant. A puck 50 located at the uppermost end of the tent 10 provides means for bowing the legs 21 into their final deployed state and locking the legs 30 (and therefore the frame assembly) into place. An optional flap or door cover 15 can be provided to cover the front opening 17.

When fully deployed, the tent 10 is a dome-shaped tent preferably about 24 inches high with a 24-inch by 24-inch base. Other sizes can be specified provided that, when deployed, a user can stand outside of the tent's perimeter and reach the puck 50.

Figure 4:
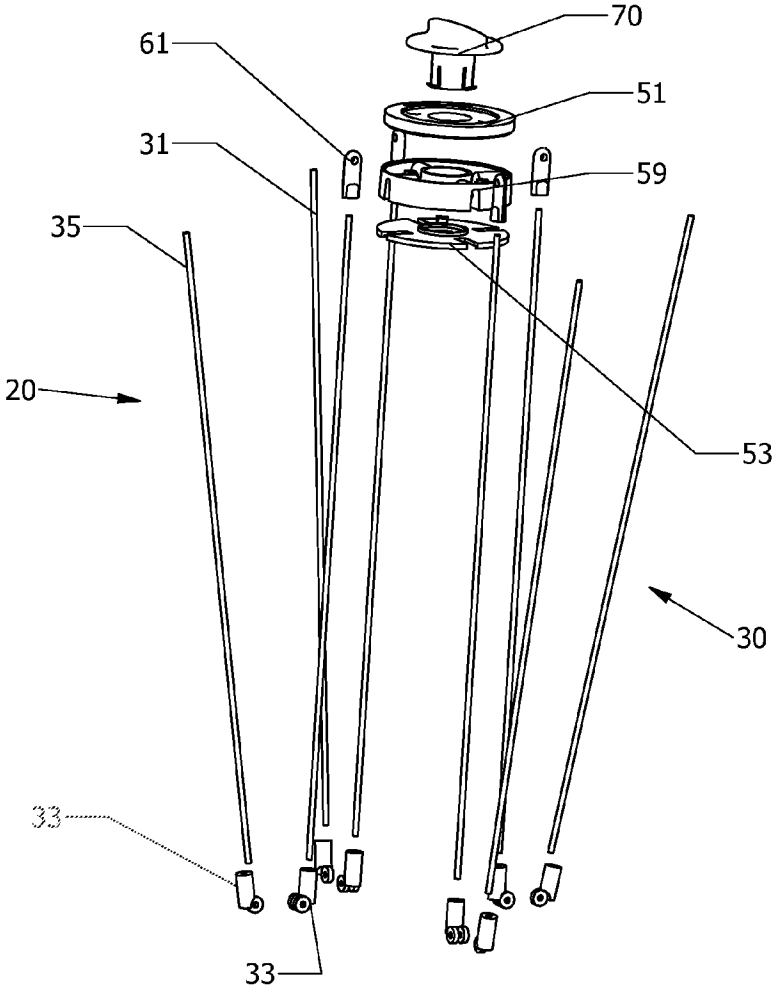
FIG. 4 is an assembly view of the frame of the tent of FIG. 1.
Figure 5:
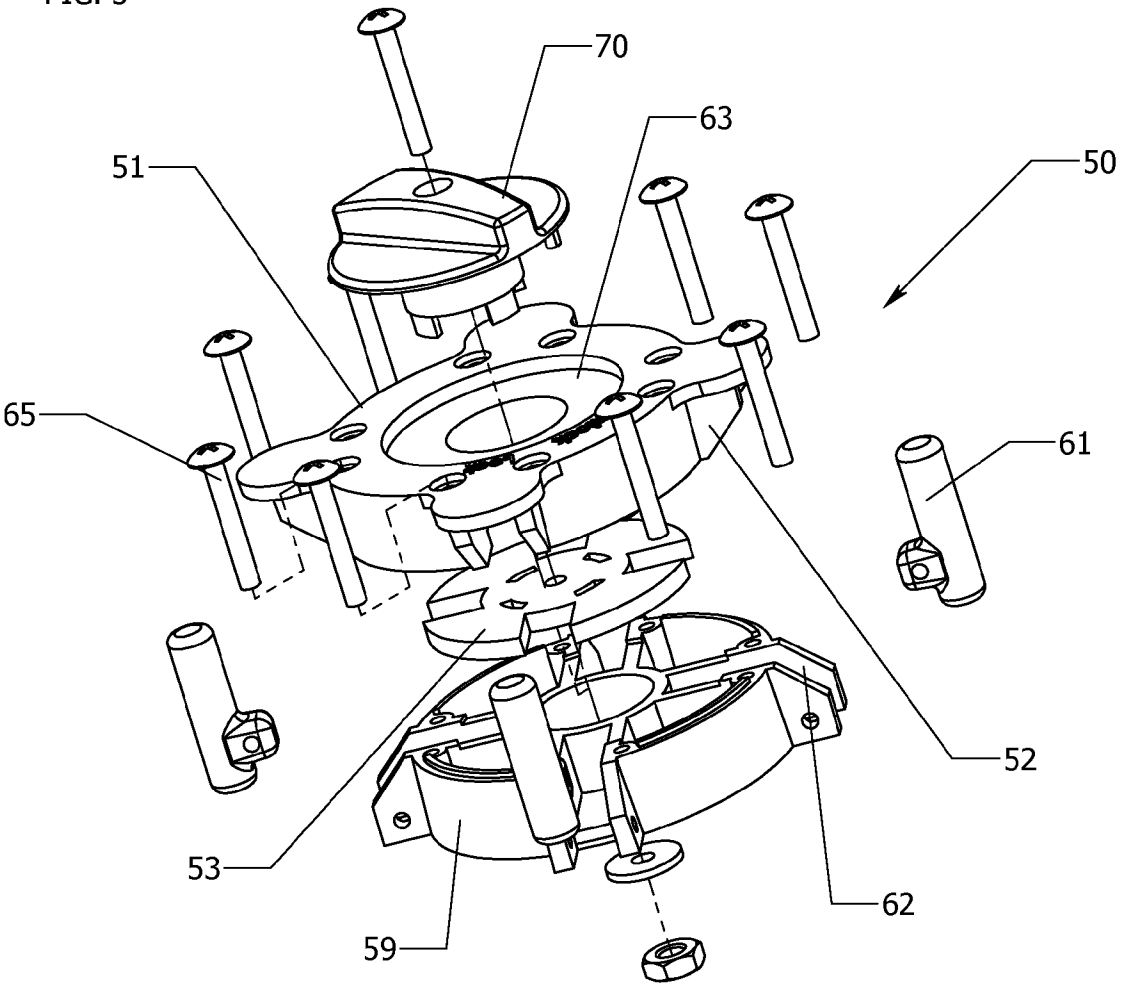
FIG. 5 is an exploded assembly view of a preferred embodiment of the puck located at the uppermost end of the tent of FIG. 1.
Figure 6A:
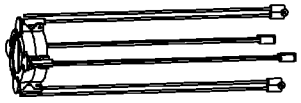
FIG. 6A is a view of the frame of for the tent of FIG. 1 when in a stowed state.
Figure 6B:
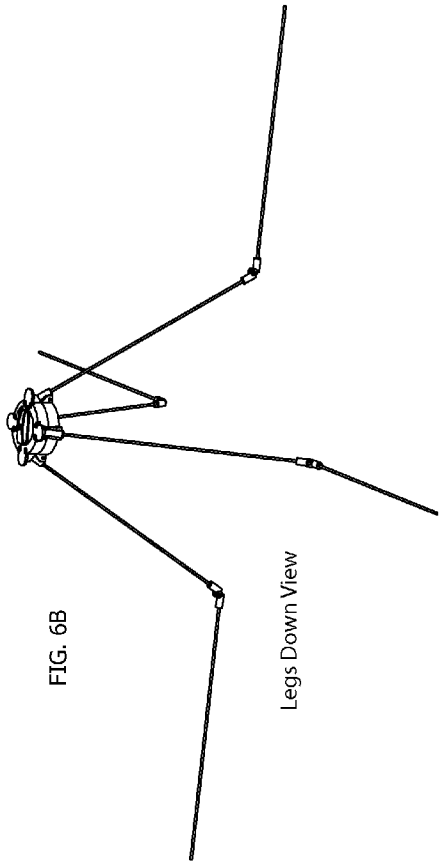
FIG. 6B is a view of the frame as it moves into a deployed state.
Figure 6C:
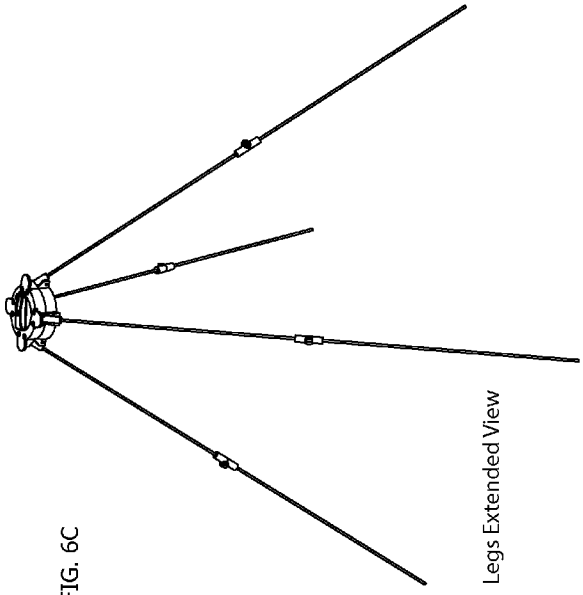
FIG. 6C is a view of the frame immediately prior to a user pushing down on the puck and forcing the legs to bow further outward.
Figure 6D:
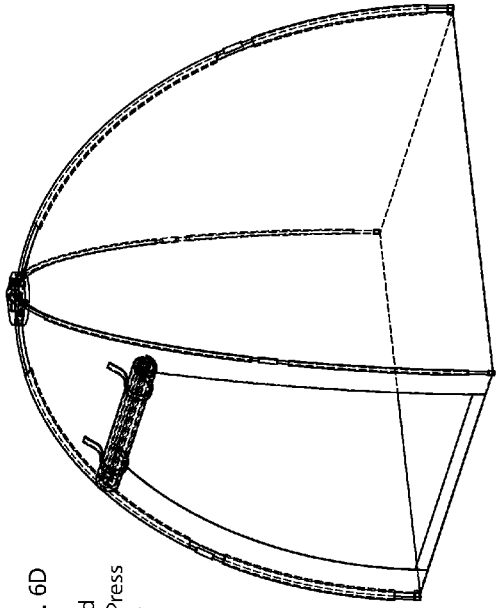
FIG. 6D is a view of the frame as the legs of the frame bow out.
Figure 9:
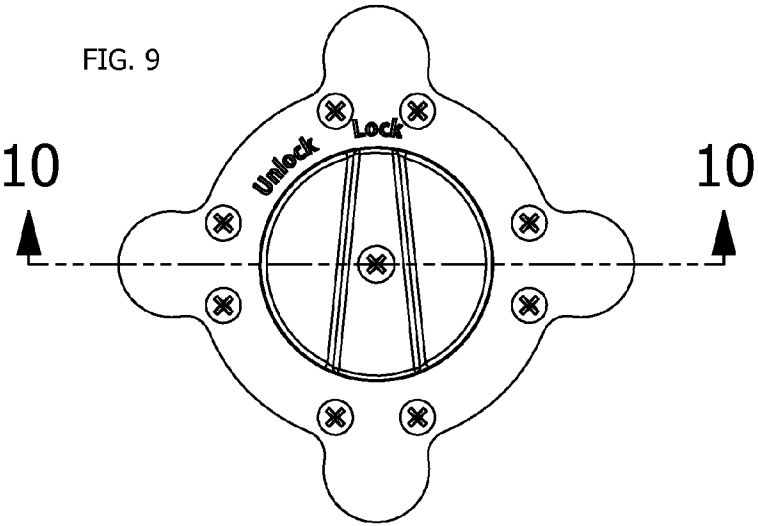
FIG. 9 is a top view of the puck of FIG. 7 in the locked position.
Figure 10:
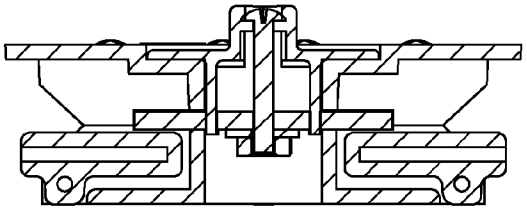
FIG. 10 is a section view taken along section line 10-10 of FIG. 9.
Figure 7:
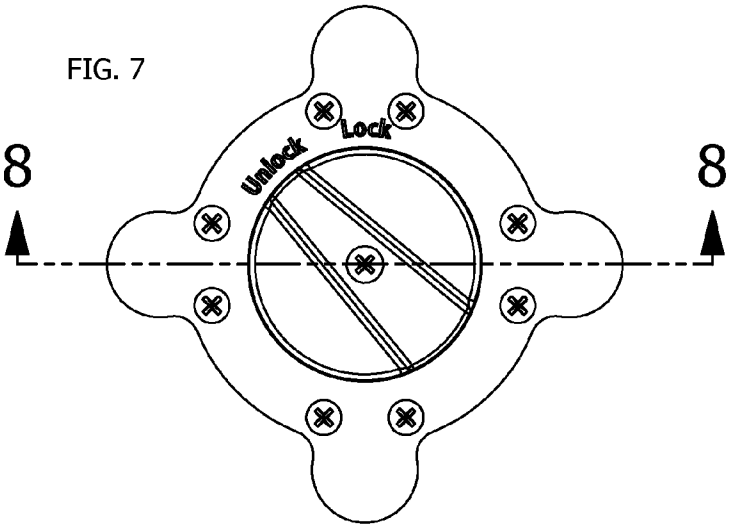
FIG. 7 is a top view of a preferred embodiment of the puck used to place the frame into a locked and unlocked state and showing the puck in an unlocked position.
Figure 8:
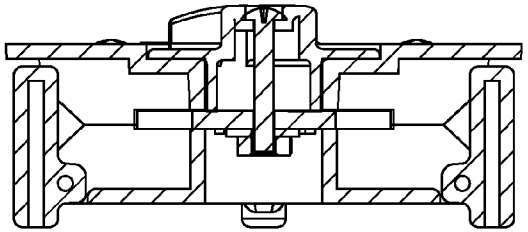
FIG. 8 is a section view taken along section line 8-8 of FIG. 7.
Figure 13:
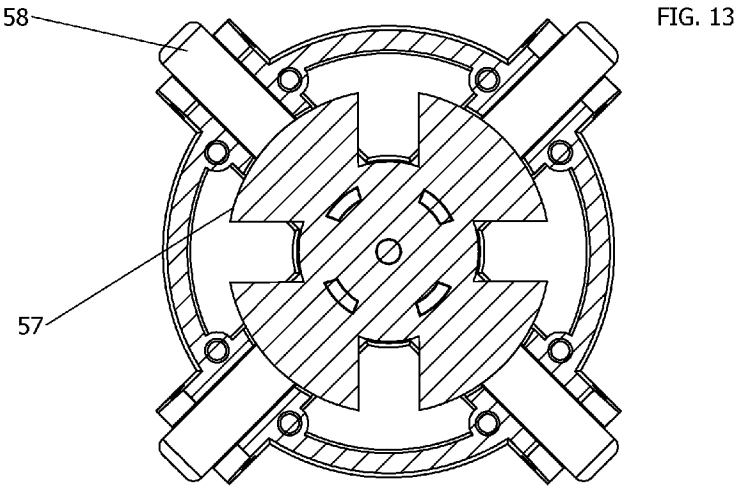
FIG. 13 is a side elevation view of the puck of FIG. 7 in the locked position.
Figure 14:
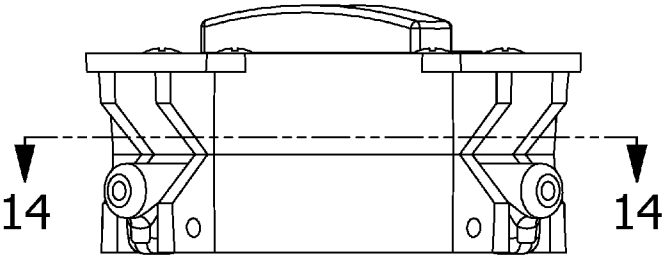
FIG. 14 is a section view taken along section line 14-14 of FIG. 13.
Figure 11:
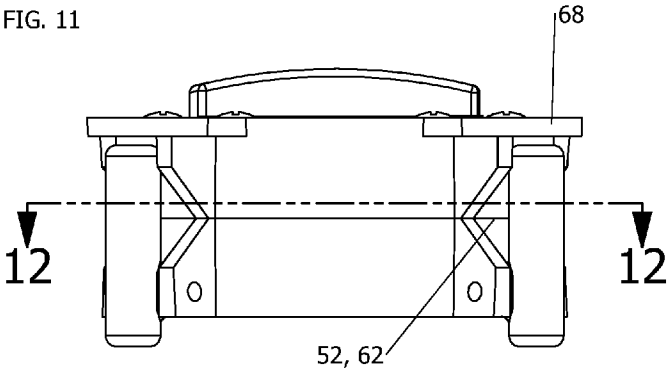
FIG. 11 is a side elevation view of the puck of FIG. 7 in the unlocked position.
Figure 12:
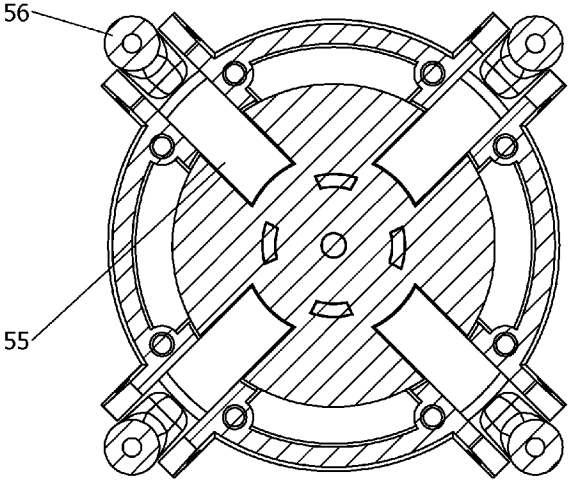
FIG. 12 is a section view taken along section line 12-12 of FIG. 11.

Referring to FIG. 4, frame assembly 20 includes a set of legs 30, with each leg 30 having an upper leg 31 and a lower leg 35 connected to one another by a two-piece leg hinge 33. When the frame assembly 20 is in the upright or substantially upright position, like that shown in FIGS. 4 and 6A, the lower leg 35 falls or drops away in an outward direction from upper leg 31 and towards the ground or table-top surface on which the tent 10 is to be erected (see FIGS. 6B and 6C). The hinge 33 is preferably arranged so that at the end of the lower leg's travel, the leg 30 is slightly urged or bowed outward at the hinge 33 (i.e., having a convex shape or an angle between the upper and lower legs 31, 35 that is slight less than 180°, for example, 165° to 175°). The hinge 33 may include includes means such as a spring or an equivalent pre-tensioning mechanism for further urging the leg 30 into an outward and bowed position.

Referring to FIGS. 5 and 7 to 14, the puck or puck body 50 includes a top plate 51, middle portion or locking plate 53, and a base 59. The base 59 of the puck 50 includes a leg connector 61, which is arranged about a pivot 67, for receiving the uppermost end of the upper leg 31 and securing it to the puck 50. The connector 61 resides between a pair of wings or flange surfaces located about the perimeter 66 of the puck body 50 that form a leg- or leg connector receiver 52, 62 of the top plate 51 and base 59, respectively. A middle portion or locking plate 53 of the puck 50 includes a set of concave polygonal-shaped notches 55 that can receive the connector 61. A convex arcuate-shaped surface 57 is located between each adjacent pair of notches 55 places the connector 61 (and therefore the leg 30) in the locked state. Together the alternating convex arcuate-shaped surfaces 57 and concave polygonal shaped surfaces 55 define the perimeter 54 of the locking plate 53.

The middle portion or locking plate 53 is moved between the unlocked and locked states by turning a knob 70 clockwise or counterclockwise. Knob 70 sits in a central recess 63 of the top plate 51 and mates to middle portion 53. Pins or fasteners 65 secure the puck 50 in an assembled state. To use the tent 10, a user holds onto the puck 50 and lifts the tent 10 upright so that the lowermost end of each leg 30 touches the ground or table top surface, with the legs 30 slightly bowed outwards (see e.g., FIGS. 6A to 6C). The user then pushes down on the puck 50 to bow the legs 30 further outward to tighten the fabric 11 and create a dome-shaped tent 10. As the legs 30 bow, the connector 61 pivots about its pivot point 67. Once the legs 30 are bowed into a final position, a knob 70 is turned to lock the legs 30 and, therefore, the frame assembly 20 into place.

The locking plate 53 is an a teeter-totter type relationship to the connector 61 as the knob 70 rotates the plate 53 between the fully locked and fully unlocked positions (see e.g. FIGS. 11 to 14). When in the fully locked position, the convex arcuate surface 57 urges against connector 61 and prevents any further pivoting or movement of the connector 61. The horizontal centerline 58 of the convex arcuate-shaped surface 57 is aligned with the vertical centerline of the leg receiver 52, 62. Unlocking the puck 50 by turning the knob back to its unlocked position releases the tension on the legs 30, which can then collapse and can be folded for compact storage of the tent 10. When in the fully unlocked position, the horizontal centerline 56 of the concave polygonal-shaped notch 55 is aligned with the vertical centerline of the leg receiver 52, 62.

The puck 50 could be arranged to automatically return to the locked position once the legs 30 are deployed into a final bowed shape. For example, a torsion spring (not shown) or its equivalent could be used to accomplish this.

Tent 10 may be sized taller than 24-inches and wider than the 24-inch by 24-inch base. The limiting factor to tent size is an envelope or boundary defined by the height of a user's reach (either assisted or unassisted when standing upright or slightly bent) and the length of that reach relative to the forward end of the user's foot (which should be clear of the tent's base when fully deployed).

The preferred embodiment described is not all of the possible embodiments of the invention. The invention is defined by the following claims which cover elements equivalent to those specifically recited in the claims.

What is claimed:

1. A locking mechanism for a tent frame, the locking mechanism comprising:

a puck body including a top plate located at an uppermost end, a base located at a lowermost end, and a flat locking plate located between the top plate and the base, the top plate including a central recess housing a knob arranged to engage and rotate the flat locking plate between a fully unlocked and a fully locked position, the top plate and base each including at least three leg receivers arranged about a perimeter, each leg receiver aligned with an opposing corresponding leg receiver of the top plate or the base, respectively;

at least three leg connectors, each leg connector pivotally connected to a corresponding leg receiver of the base and arranged to move between a vertical position when the locking plate is in a fully unlocked position to a horizontal position when the locking plate is in the fully locked position, each leg connector when in the vertical and horizontal positions located entirely below the uppermost end of the puck body.

2. A locking mechanism according to claim 1 further comprising a leg connected to each leg connector, each leg including a hinge between an upper and a lower end of the leg and arranged to permit a lower end of the leg to fall away from the upper end of the leg and create an outward bow of the leg when a vertical downward force is applied to the puck body.

3. A portable changing tent comprising:

a frame assembly including at least three legs and a puck located at an uppermost end of the frame assembly, the puck including a top plate at an uppermost end of the puck and a base at the lowermost end of the puck, the top plate and the base each including at least three leg receivers, the puck housing a locking plate located between the top plate and the base, the base further including at least three leg connectors each pivotally connected to a corresponding leg receiver of the base and arranged to move between a housed vertical position entirely between the uppermost and lowermost ends of the puck and a housed horizontal position when the locking plate is in a fully unlocked and a fully locked position, respectively;

a knob located at an uppermost end of the puck and arranged to rotate the locking plate between the fully unlocked and a fully locked positions;

each leg further having a hinge located between an upper and a lower end of the leg that permits a lower end of the leg to fall away from a respective upper end of the leg and, when a vertical downward force is applied to the locking mechanism, each leg having an outward bow along its length.

4. A portable changing tent according to claim 3 further comprising the locking plate having a perimeter defined by at least three sets of alternating concave- and convex-shaped surfaces.

5. A locking mechanism for a tent frame, the locking mechanism comprising:

a puck body including a top plate located at an uppermost end, a base located at a lowermost end, and a flat locking plate located between the top plate and the base, the top plate including a central recess housing a knob arranged to engage and rotate the flat locking plate between a fully unlocked and a fully locked position, the base including at least three leg receivers arranged about a perimeter each with a leg connector arranged in pivotal relation to a respective leg receiver, each leg connector when in a vertical and a horizontal position located entirely between the uppermost and lowermost ends of the puck body.

* * * * *